US005194013A

United States Patent [19]

Propp

[11] Patent Number: 5,194,013

[45] Date of Patent: Mar. 16, 1993

[54] LOCK PLUG

[76] Inventor: Morris Propp, 33 E. End Ave., New York, N.Y. 10028

[21] Appl. No.: 833,947

[22] Filed: Feb. 11, 1992

[51] Int. Cl.[5] ..... H01R 13/15

[52] U.S. Cl. ..... 439/265; 439/102

[58] Field of Search ..... 439/102–104, 439/106, 176, 265, 304, 324, 346, 784, 805

[56] References Cited

U.S. PATENT DOCUMENTS

| | | | |
|---|---|---|---|
| 1,605,904 | 11/1926 | Brunt | 439/265 |
| 2,593,981 | 4/1952 | Capita | 439/265 |
| 3,858,956 | 11/1975 | Garrett | 439/106 |
| 3,890,025 | 6/1975 | Gray | 439/265 |
| 4,820,187 | 4/1989 | May | 439/346 |

FOREIGN PATENT DOCUMENTS

| | | | |
|---|---|---|---|
| A057102 | 12/1952 | France | 439/324 |

*Primary Examiner*—Larry I. Schwartz
*Assistant Examiner*—Hien D. Vu
*Attorney, Agent, or Firm*—Richard L. Miller

[57] ABSTRACT

A locking electrical plug is provided which has a cooperating tool/key which when rotated in a first direction causes a ground prong extending therefrom to be mechanically expand within a mating female receptacle, thereby preventing inadvertent or accidental removal of the plug from the receptacle, and when rotated in a second direction this again permits the removal of the plug from the receptacle.

3 Claims, 1 Drawing Sheet

LOCK PLUG

BACKGROUND OF THE INVENTION

The instant invention relates generally to electrical components and more specifically it relates to a locking electric plug.

Numerous electrical components have been provided in the prior art that are adapted to be retained to conventional mating electrical components, so that they cannot be separated easily. For example, U.S. Pat. Nos. 3,790,914 to Hough; 4,111,509 to Novak and 4,784,611 to Poulin et al all are illustrative of such prior art. While these units may be suitable for the particular purpose to which they address, they would not be as suitable for the purpose of the present invention as hereafter described.

SUMMARY OF THE INVENTION

A primary object of the present invention is to provide a lock plug that will overcome the shortcomings of the prior art devices.

Another object is to provide a lock plug that has a built-in structure which permits it to be fixedly secured into a standard wall socket with a standard tool/key whereby it cannot be removed without using the standard tool/key.

An additional object is to provide a lock plug, so that the plug cannot be unintentionally removed from the standard wall socket, either by inadvertent carelessness, accident or by casual mischief.

A further object is to provide a lock plug that is simple and easy to use.

A still further object is to provide a lock plug that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
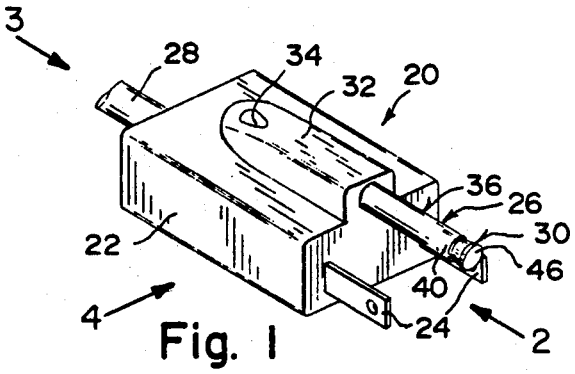
FIG. 1 is a diagrammatic perspective view of the instant invention per se.
Figure 2:
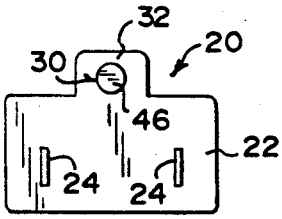
FIG. 2 is a front elevational view taken in the direction of arrow 2 in FIG. 1.
Figure 3:
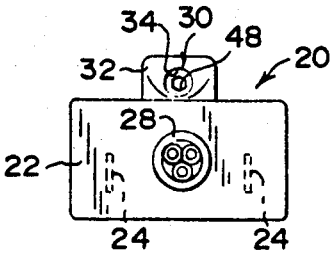
FIG. 3 is a rear elevational view taken in the direction of arrow 3 in FIG. 1.
Figure 4:
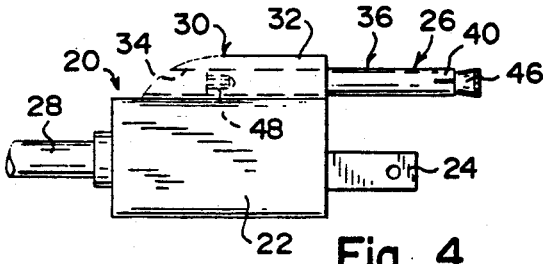
FIG. 4 is a side elevational view taken in the direction of arrow 4 in FIG. 1.
Figure 5:
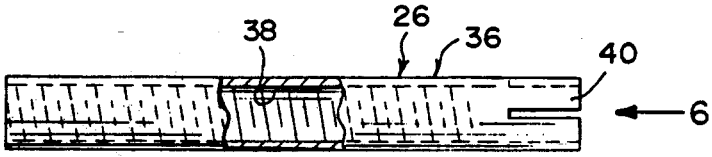
FIG. 5 is an enlarged diagrammatic partially sectioned side view of the ground prong thereof.
Figure 6:
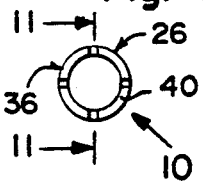
FIG. 6 is a front view taken in the direction of arrow 6 in FIG. 5.
Figure 7:
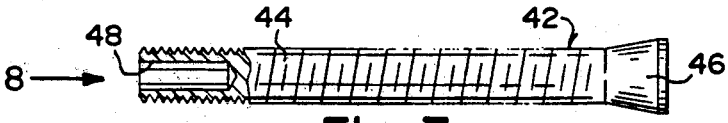
FIG. 7 is an enlarged diagrammatic partially in section side view of the threaded shaft which cooperates with the ground prong illustrated in FIG. 5.
Figure 8:
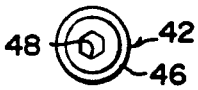
FIG. 8 is a rear view taken in the direction of arrow 8 in FIG. 7.
Figure 9:
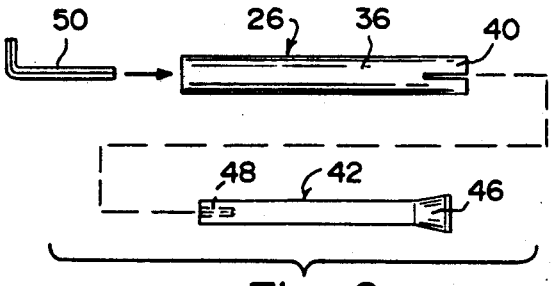
FIG. 9 is a reduced diagrammatic exploded side view illustrating the cooperation between the ground prong and the threaded shaft best illustrated in FIGS. 5 and 7.
Figure 10:
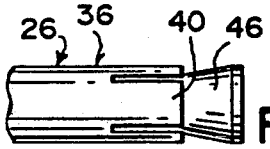
FIG. 10 is a slightly enlarged partial side view taken in the direction of arrow 10 in FIG. 6 with the threaded shaft installed in the ground prong.
Figure 11:
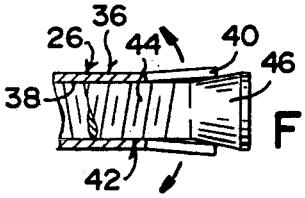
FIG. 11 is a diagrammatic cross sectional side view with parts broken away taken on line 11—11 in FIG. 8 with the threaded shaft installed in the ground prong.

Turning now descriptively to the drawings, in which similar reference characters denote similar elements throughout the several views, the Figures illustrate instant invention, a lock plug 20, which consists of a housing 22 and a pair of contact blades 24 extending from the housing 22 sized for insertion in a convention electrical grounding receptacle (not shown). A ground prong 26 also extends from the housing 22 and is sized for insertion in the electrical grounding receptacle. An electrical cord 28 extends from the housing 22 and is connected to the contact blades 24 and the ground prong 26. A mechanism 30 is provided for locking the ground prong 26 within the electrical grounding receptacle.

The locking mechanism 30 includes a casing 32 formed on the housing 22, having a bore 34 therethrough. The ground prong 26 is a cylindrical shaped hollow sleeve having internal threads 38 and a split end 40. Ground prong 26 is mounted within the bore 34 of the casing 32, so that the split end 40 extends therefrom. A shaft 42 is provided having external threads 44, an enlarged tapered head 46 on a first end and a mechanical key shape, typically a hexagonal socket 48 on the second end. The shaft 42 is insertable into the cylindrical shaped hollow sleeve 36, so that the external threads can engage with the internal threads 38 and the enlarged tapered head 46 can engage with the split end 40. A tool/key 50 is cooperates with the socket 48 in the second end of the shaft 42 so that when rotated, in a first direction, the shaft 42 will be drawn into the cylindrical shaped hollow sleeve 36 whereby the enlarged tapered head 46 will cause the spreading of the split end 40, which in turn will tighten the fit of the ground prong 26 within a mating female receptacle, an effectively prevent the inadvertent removal of the lock plug 20 from the convention electrical grounding receptacle (not shown).

Conversely when the tool/key 50 is rotated in a second direction this again permits the removal of the plug 20 from the receptacle.

The socket 48 in the second end of the shaft 42 is illustrated typically as an Allen head configuration and the tool/key 50 is typically a mating Allen wrench, although there are an unlimited variety of other suitable configurations. The cylindrical shaped hollow sleeve 36 and the shaft 42 are fabricated out of a strong durable electrically conductive metal.

As a brief review to retain the lock plug within the electrical grounding receptacle the following steps should be taken:

1. Insert the contact blades 24 and the ground prong 26 into the electrical grounding receptacle.

2. Insert the Allen wrench tool/key 50 into the Allen head socket 48 and turn it counterclockwise to spread the split end 40 to lock the lock plug 20 in place.

To release the lock plug within the electrical grounding receptacle the following steps should be taken:

1. Insert the Allen wrench tool/key 50 into the Allen head socket 48 and turn it clockwise, so that the split end 40 will return to its original position.

2. Remove the contact blades 24 and the ground prong 26 from the electrical grounding receptacle.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A lock plug which comprises:

a) a housing;

b) a pair of contact blades extending from said housing sized for insertion in a mating electrical grounding receptacle;

c) a ground prong extending from said housing sized for insertion in the electrical grounding receptacle;

d) an electric cord extending from said housing and electrically connected to said contact blades and ground prong; and e) means for securing said ground prong within the electrical grounding receptacle, wherein said securing means includes:

i) a casing formed on said housing having a bore therethrough;

ii) said ground prong being a cylindrical shaped hollow sleeve having internal threads and a split end, said ground prong mounted within the bore of said casing, so that the split end extends therefrom;

iii) a shaft having external threads, an enlarged tapered head on a first end and a mechanical key shape on a second end, with said shaft rotatively installed into said cylindrical shaped hollow sleeve, so that the external threads can engage with the internal threads and the enlarged tapered head can engage with the split end; and iv) a tool/key which cooperates with said mechanical key shape on the second end of said shaft to rotate and cause said shaft to be drawn into said cylindrical shaped hollow sleeve for spreading the split end and tightening the fit of said hollow sleeve in a mating female receptacle thereby locking said ground prong within the electrical grounding receptacle.

2. A lock plug as recited in claim 1, wherein the mechanical key shape on the second end of said shaft is an Allen head configuration and said tool/key is an Allen wrench.

3. A lock plug as recited in claim 2, wherein said cylindrical shaped hollow sleeve and said shaft are fabricated out of a strong durable metal.

* * * * *